US005924876A

United States Patent [19]

Beamenderfer et al.

[11] Patent Number: 5,924,876

[45] **Date of Patent: *Jul. 20, 1999**

[54] HIGH DENSITY ELECTRICAL CONNECTOR HAVING AN ALIGNMENT FEATURE

[75] Inventors: Robert Eugene Beamenderfer; Barbara Ann McGarvey, both of Palmyra, Pa.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/816,609

[22] Filed: Mar. 13, 1997

Related U.S. Application Data

[60] Provisional application No. 60/034,278, Dec. 19, 1996.

[51] Int. Cl.[6] ..... H01R 9/09

[52] U.S. Cl. ..... 439/79

[58] Field of Search ..... 439/79, 80, 83, 439/876, 381, 59, 62, 65, 590, 942

[56] References Cited

U.S. PATENT DOCUMENTS

| | | | |
|---|---|---|---|
| 4,392,705 | 7/1983 | Andrews, Jr. et al. | 439/342 |
| 4,618,209 | 10/1986 | Sonobe | 439/395 |
| 4,734,042 | 3/1988 | Martens et al. | 439/62 |
| 4,793,816 | 12/1988 | Pittman et al. | 439/79 |
| 4,808,115 | 2/1989 | Norton et al. | 439/79 |
| 4,857,017 | 8/1989 | Erk | 439/79 |
| 5,090,116 | 2/1992 | Henschen et al. | 29/827 |
| 5,133,670 | 7/1992 | Doi et al. | 439/79 |
| 5,201,664 | 4/1993 | Korsunsky et al. | 439/83 |
| 5,213,514 | 5/1993 | Arai | 439/79 |
| 5,272,807 | 12/1993 | Henschen et al. | 439/874 |
| 5,409,384 | 4/1995 | Green et al. | 439/67 |

FOREIGN PATENT DOCUMENTS

| | | | |
|---|---|---|---|
| 1484730 | 9/1973 | Germany | H05K 1/12 |

OTHER PUBLICATIONS

U.S. Patent Application Serial No. 08/703,765, filed Aug. 27, 1996, abstract & drawings only.

Customer Drawing No. 447444 by AMP Incorporated.

*Primary Examiner*—Neil Abrams
*Assistant Examiner*—Barry M. L. Standig
*Attorney, Agent, or Firm*—Mary K. Van Atten

[57] ABSTRACT

The invention comprises an electrical connector having a housing with a plurality of contacts mounted therein. The contacts have connection sections and solder tails. The solder tails are aligned with each other and have contact surfaces. An alignment member has grooves therealong to receive the solder tails therein. The solder tails are secured within the grooves to ensure that the solder tails are properly aligned with each other.

21 Claims, 6 Drawing Sheets

HIGH DENSITY ELECTRICAL CONNECTOR HAVING AN ALIGNMENT FEATURE

"This application claims the benefit of U.S. Provisional Application(s) Ser. No(s). 60/034,278, Filed Dec. 19, 1996."

FIELD OF THE INVENTION

The present invention is directed towards a high density electrical connector, and in particular, towards an electrical connector to provide electrical connection between two circuit boards.

BACKGROUND OF THE INVENTION

Electrical connectors are often used to provide a right angle connection between two circuit boards. As the numbers of electrical connections required between the two boards become greater, the electrical connector must have a higher density of electrical contacts because space on the printed circuit boards are at a premium and the electrical connector must be maintained as small as possible. One set of the electrical connections to the board are often made by way of solder tails which are received up against one of the circuit boards and soldered thereto. Because of the high density of these solder tails it is very important to make sure they remain precisely aligned with each other to ensure the correct electrical connections are made on the printed circuit board.

What is needed is the electrical connector having solder tails which are aligned to ensure that the contact portion remains aligned during the soldering step.

SUMMARY OF THE INVENTION

The invention comprises an electrical connector having a housing with a plurality of contacts mounted therein. The contacts have connection sections and solder tails. The solder tails are aligned with each other and have contact surfaces. An alignment member has grooves therealong to receive the solder tails therein. The solder tails are secured within the grooves to ensure that the solder tails are properly aligned with each other.

The invention further comprises an electrical connector for providing electrical connection from a first circuit board to a second circuit board. The connector comprises a housing having a plurality of contacts therein. The contacts have connection sections for electrically connecting with the first circuit board. The contacts have solder tails with contact surfaces for electrical connection with the second circuit board. An alignment member having grooves therealong is received on the solder tails, the solder tails being received within the grooves, to ensure proper alignment of the solder tails.

BRIEF DESCRIPTION OF THE DRAWING

An embodiment of the present invention will now be described by way of example with reference to the accompanying drawings, in which.

DETAILED DESCRIPTION OF THE INVENTION

Figure 1:
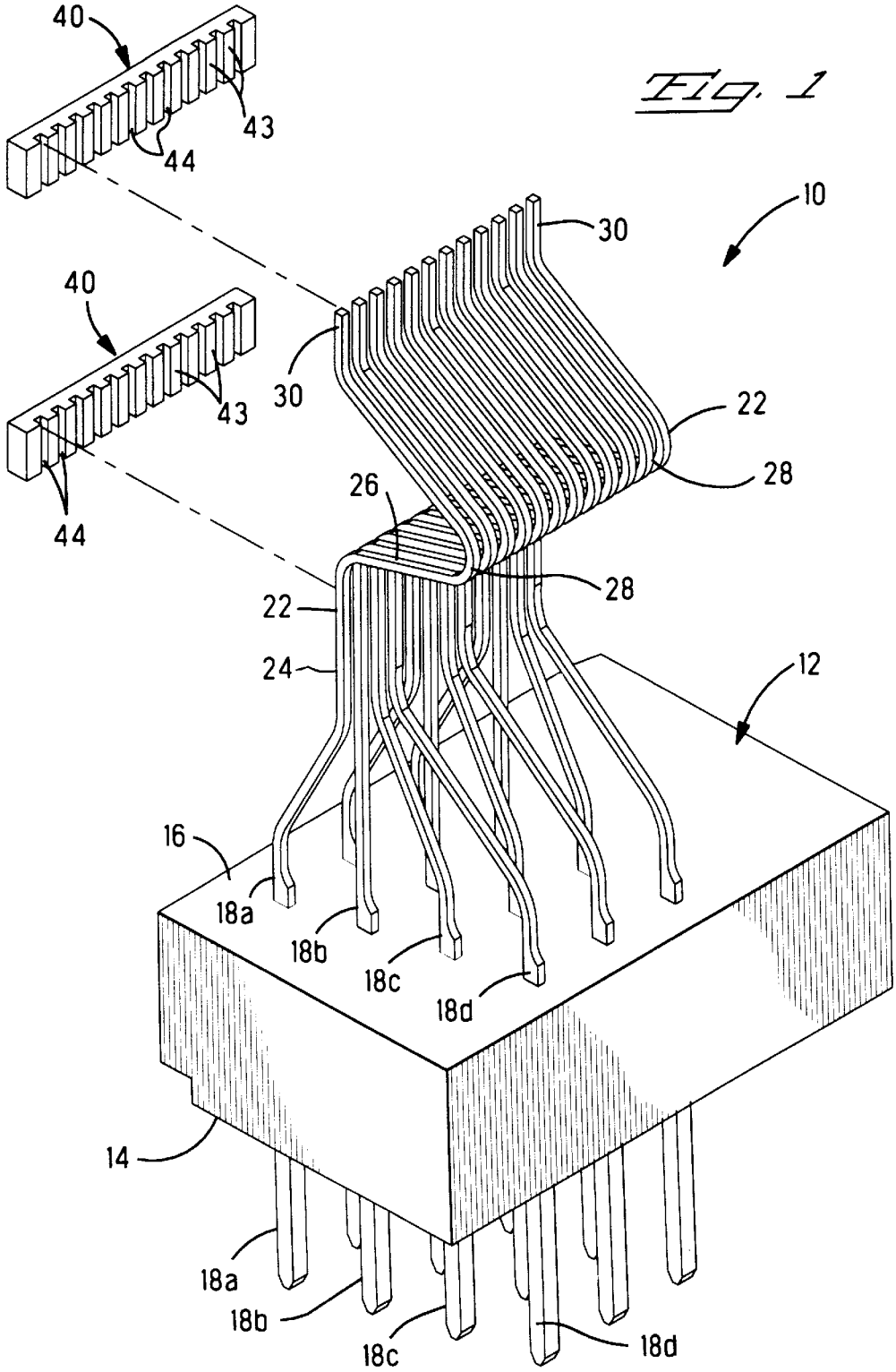
FIG. 1 is an exploded isometric view showing the high density connector and the alignment member exploded away from the connector.

The present invention is directed to an electrical connector for providing electrical connection between two printed circuit boards. In particular, the electrical connector provides pins to be received in through holes on the first circuit board and solder tails to provide an electrical contact surface to the second circuit board. It is to be understood however, that the electrical connection to the first printed circuit board could be some form other than pins in through holes, for instance, the connection to the first circuit board could also be by way of a surface mount solder tails. Further, while the electrical connector is shown having only 12 contacts mounted therein, it is to be understood that the contacts would be mounted along the entire length of the housing thereby providing a large number of connections between the circuit boards.

The electrical connector 10 has a dielectric housing 12 having a plurality of contacts 18 mounted therein. The housing 12 has a mounting face 14 and a second face 16 which is opposite to the mounting face 14. The contacts 18 extend from the mounting face 14 to the second face 16.

Figure 4:
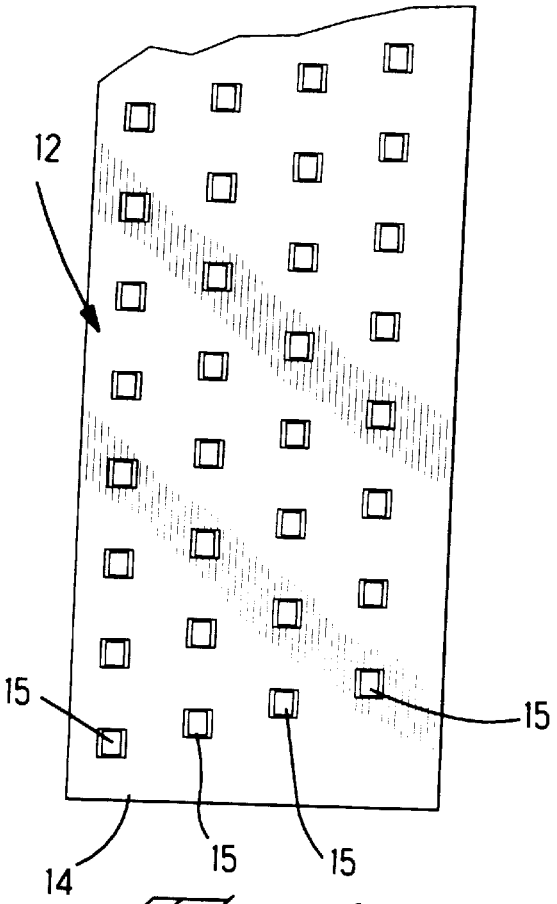
FIG. 4 is a bottom view of the housing of the electrical connector showing the high density spacing of the contacts therein.

The contact 18 are mounted within the housing 12 so that the contacts are disposed in diagonal columns, that is there are four contacts disposed diagonally along one column and the next four contacts are disposed diagonally along the next column. FIG. 4 shows a bottom view of the electrical connector housing 12 showing the mounting face 14 with contact receiving cavities 15 disposed therealong. As can be seen from this view the cavities receive the contacts 18 in a staggered arrangement so that a high density of contacts can be secured within the housing. The electrical connector provides a matrix-type of connection pattern to one circuit board and an in-line connection pattern to the other circuit board.

The contacts 18*a*, 18*b*, 18*c*, and 18*d* have identical pins 20 which are to be received in through holes in the circuit board. Further the different contacts 18*a*, 18*b*, 18*c*, and 18*d* have identical solder tails 22 which form the contact section for providing electrical connection to the other circuit board The difference between the contacts 18*a*, 18*b*, 18*c*, and 18*d* are that they are mounted along the diagonal and must be bent along the second face 16 of the housing 12 at a different angles so that the solder tails 22 can all be aligned with each other.

The solder tails 22 are all aligned with each other and have first straight portions 24 extending away from the housing 12, a second generally v-shaped, bent portion 26 which forms contact surface 28, and then ends 30. Because of the high density of the contacts and the staggered arrangement of the pins, the solder tails are all spaced very close to each other to provide a multitude of electrical connections to the printed circuit board.

The electrical connector provides connection to one circuit board in the form of an array or a matrix. The configuration of the contacts allows the connection to the second circuit board to be an in-line connection arrangement.

Figure 2:
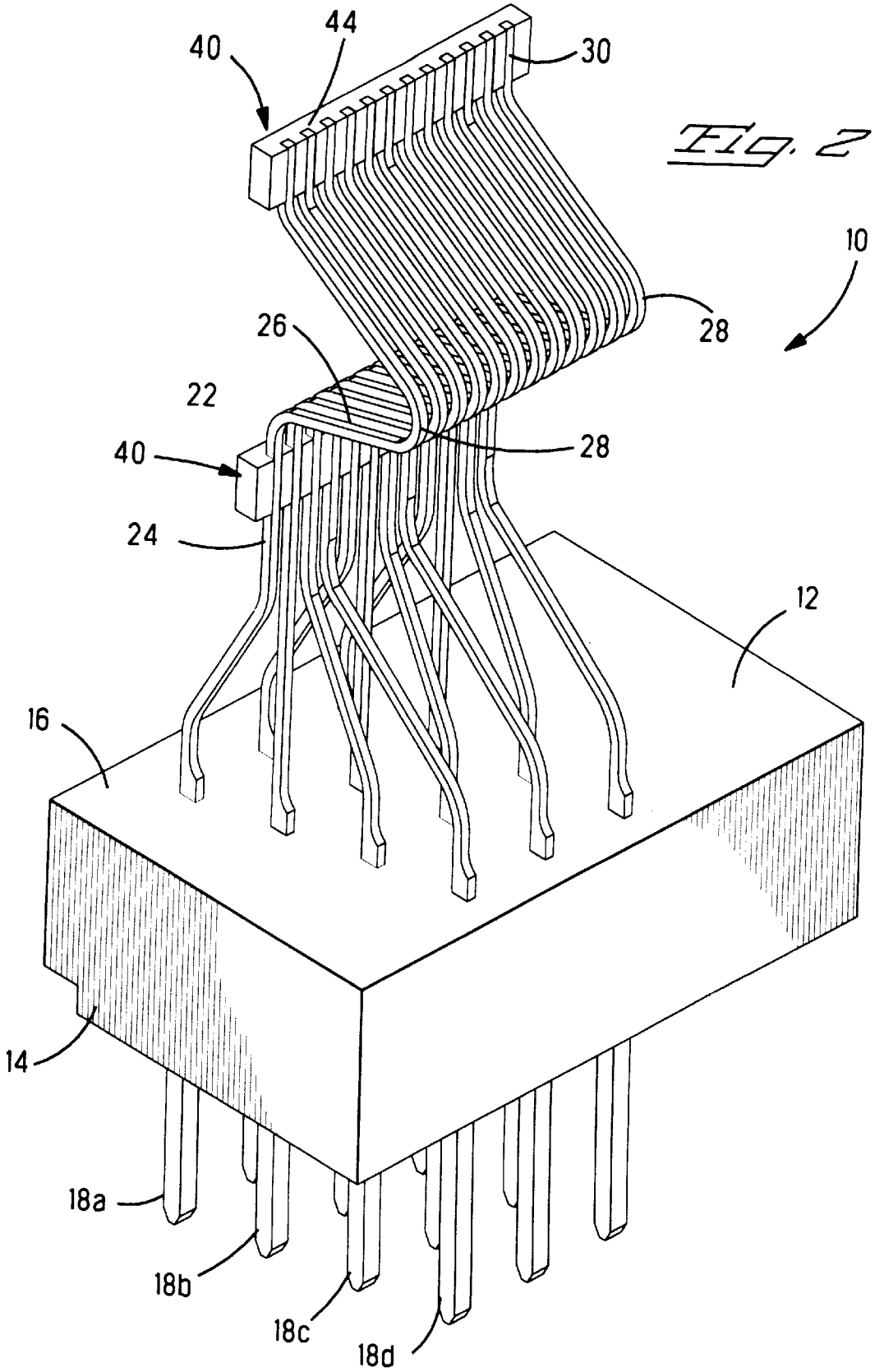
FIG. 2 is an isometric view of the electrical connector showing the alignment member mounted to the solder tails.
Figure 3:
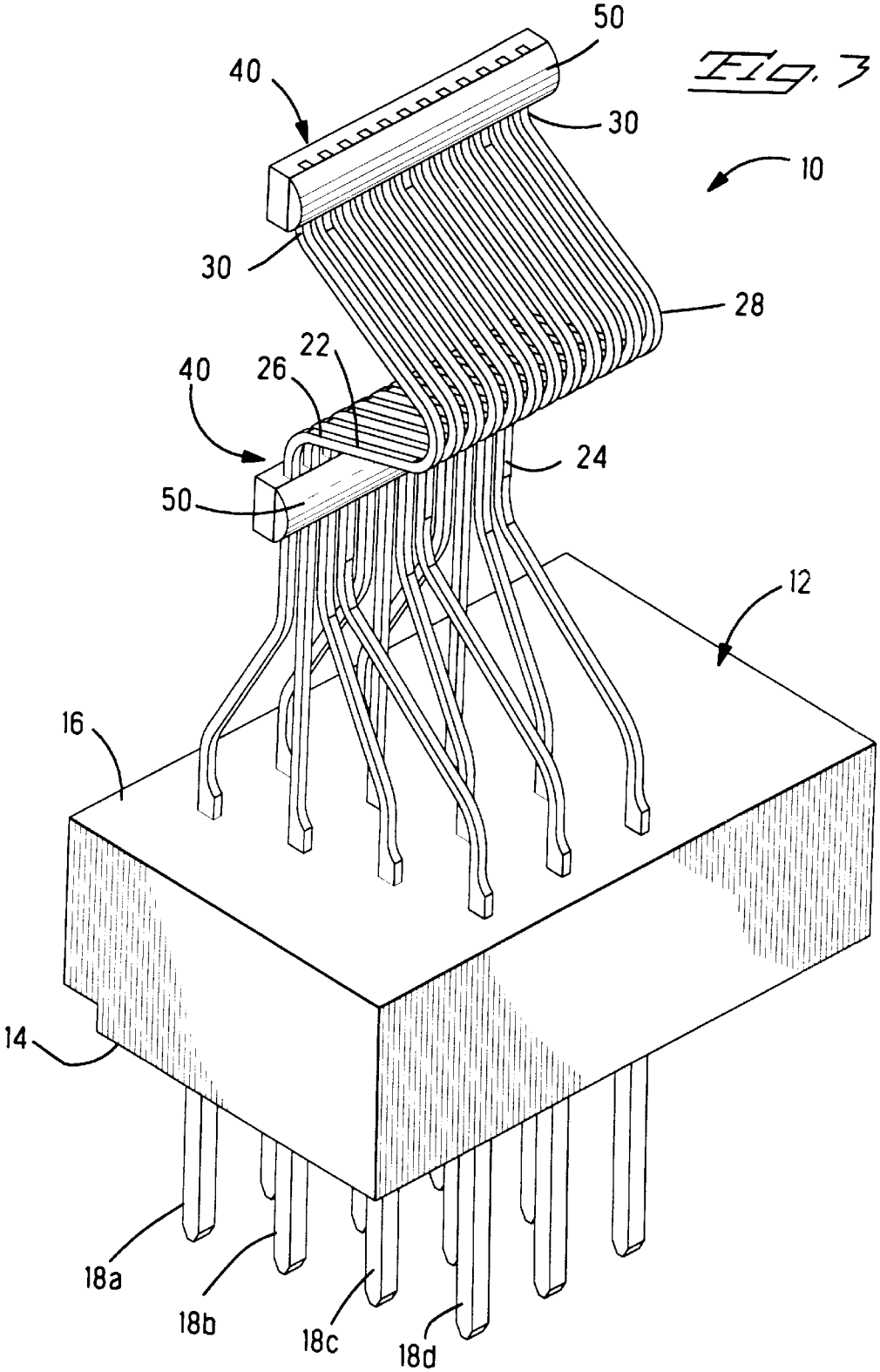
FIG. 3 is an isometric view of the electrical connector showing the alignment member secured to the contact.

The solder tails are held in alignment with each other by alignment members 40. The alignments members are made from a dielectric material and each have a housing 42 with a front face 43, the front face 43 having grooves 44 disposed therealong. The alignment member 40 is received along the solder tails 22, as is shown in FIG. 2. The solder tails are received within the grooves 44. The spacing between the grooves 44 matches the spacing between the solder tails thereby providing ease of alignment and entry of the solder tails into the grooves 44. One of the alignment members 40 is secured along the first straight portions 24 of the solder tails 22. The second of the alignment members 40 is received along the ends 30 of the solder tails 22. By using two alignment members 40 the solder tails are secured in the correct alignment with respect to each other. Because alignment members 40 are used on both sides of the contact surfaces 28, the contact surfaces are held in proper alignment with each other.

In order to secure the alignment members onto the solder tails 22, an epoxy 50 is placed along the face 43 of the alignment members 40 and over the grooves 44. It is also possible that these solder tails could be secured within the alignment member 40 using some other means such as heat staking, ultrasonic welding, adhesive application, or some other type of securing method.

Figure 5:
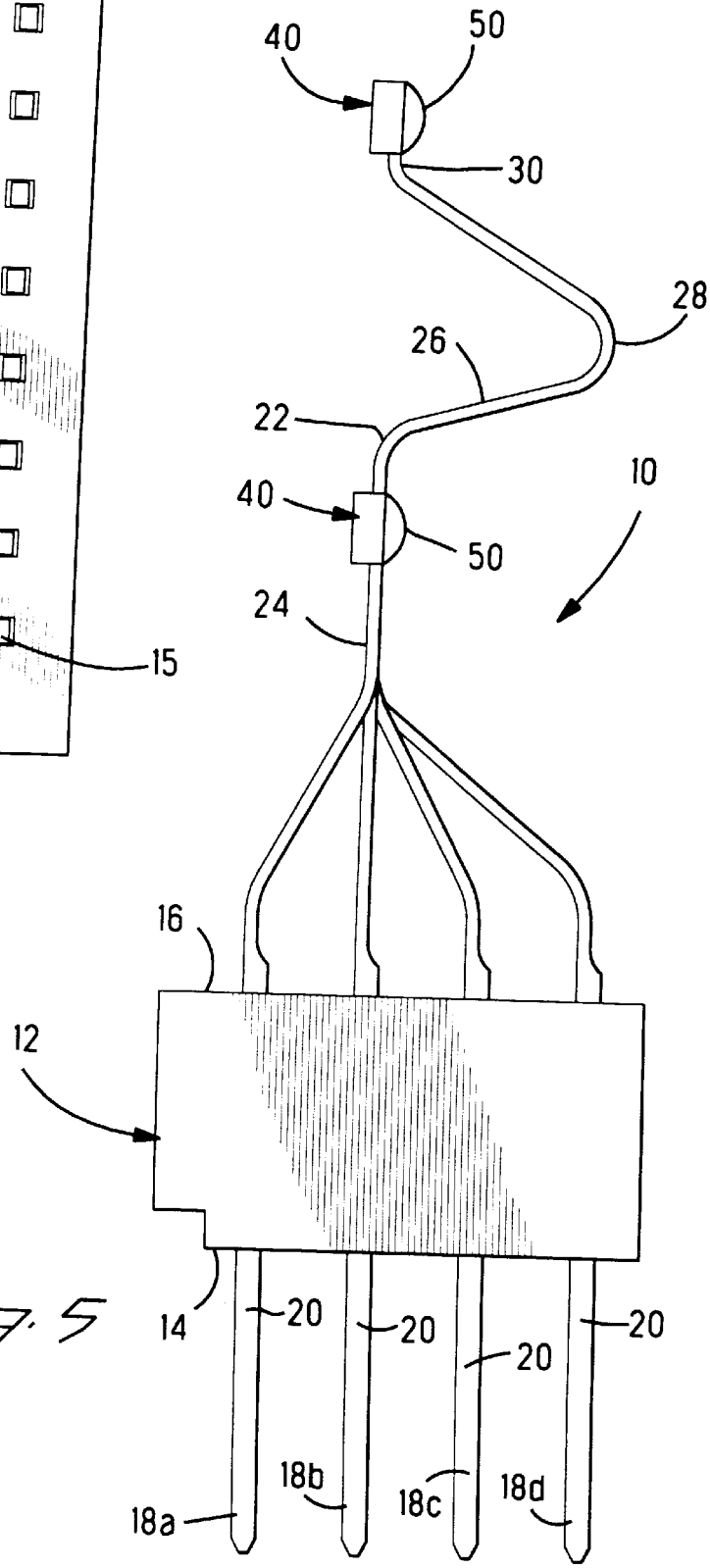
FIG. 5 is a side view of the assembled electrical connector of the present invention.

FIG. 5 shows a side view of the assembled electrical connector 10 of the present invention. As is obvious from FIG. 5, the solder tails 22 are all aligned with each other so that when the alignment members 40 are secured onto the solder tails it is easy to maintain the solder tails within the proper alignment with respect to each other.

Figure 6:
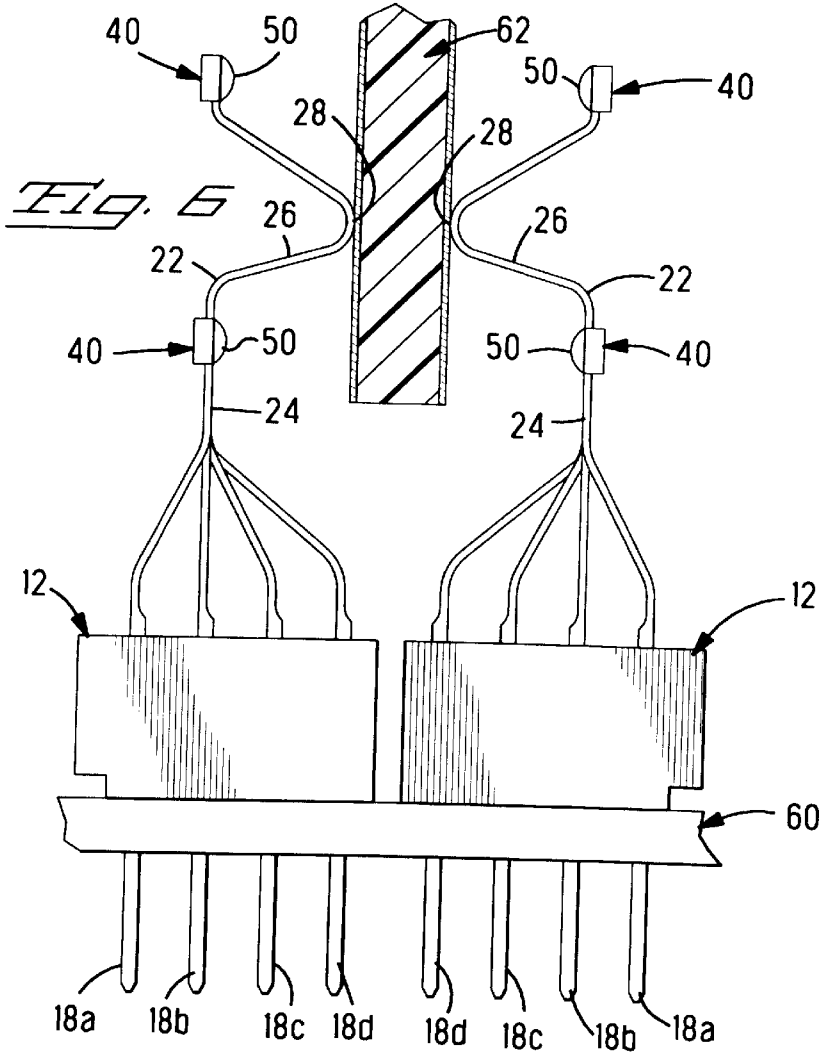
FIG. 6 is a side view of two of the electrical connectors of the present invention providing electrical connection between two circuit boards.

The electrical connector of the present invention can be used in several ways. One embodiment is shown in FIG. 6. In this embodiment two electrical connectors 10 are mounted onto printed circuit board 60 wherein pins 20 of each of the electrical connectors are received within through holes, not shown. The contact surfaces 28 from the different connectors 10 are then disposed opposite from each other. A second printed circuit board 62 can then be received between the two electrical connectors 10 so that the contact surfaces 28 on the solder tails 22 are received against contact pads, not shown, on the second circuit board 62. The alignment members 40 on both of the electrical connectors ensure that the solder tails are properly aligned with the contact pads on the second circuit board.

Figures 7, 8, 9:
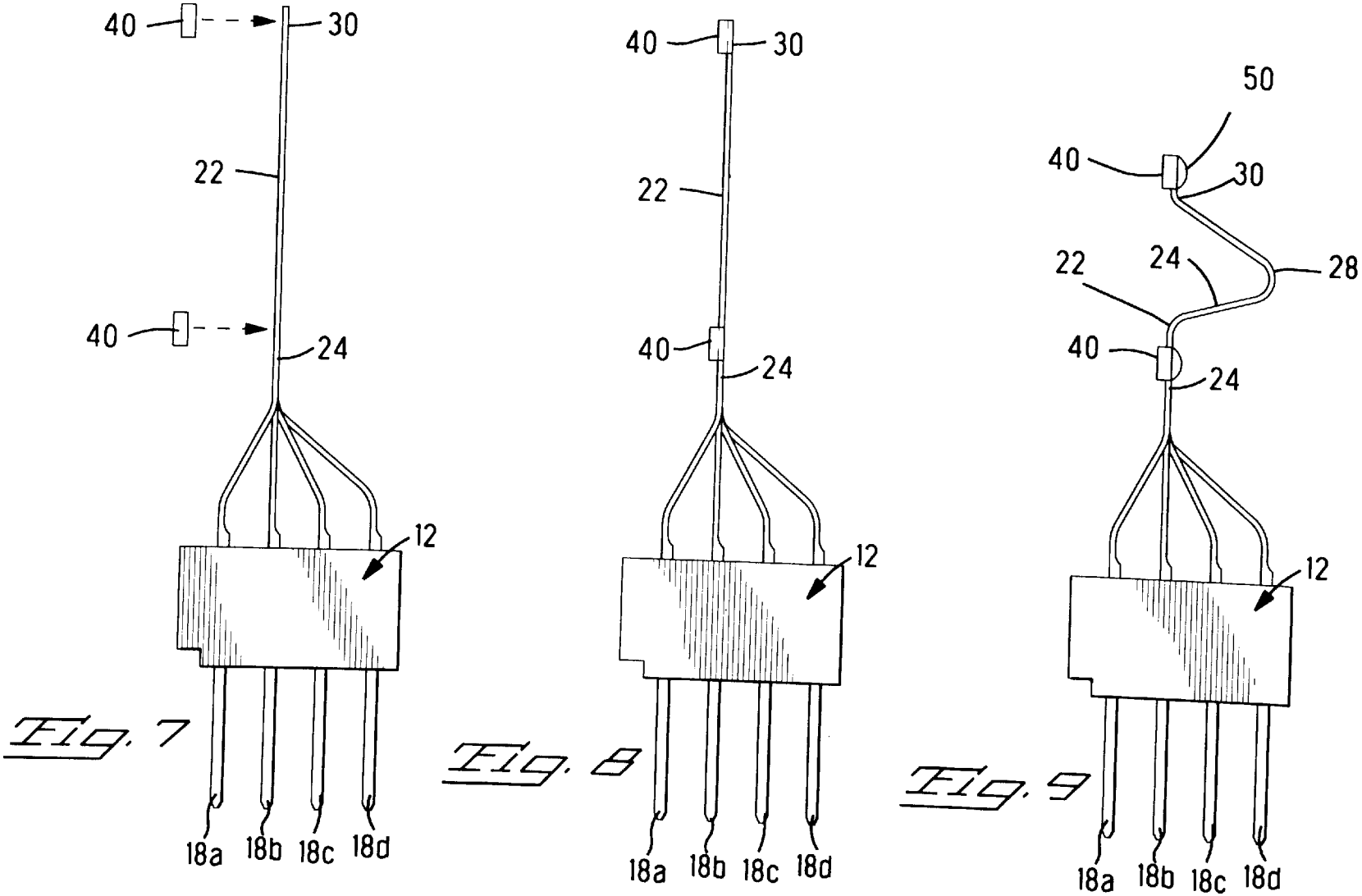
FIG. 7 is a side view showing the process used for mounting the alignment member onto the electrical connector.
FIG. 8 is a side view showing the second step in the assembly process.
FIG. 9 is a side view showing the final assembled product.

FIGS. 7, 8, and 9 show the process for the assembly of the electrical connector of the present invention. FIG. 7 shows the electrical connector 10 having contacts 18 mounted therein. As seen in this view, the solder tails 22 are all aligned with each other and they all extend straight away from the housing 12, upwardly as viewed in FIG. 7. The alignment members 40 are aligned with the solder tails and then mounted thereon so that the solder tails are received within the grooves 44 of the alignment members. Both of these alignment members 40 can be mounted at the same time, or sequentially, onto the solder tails. One of the alignment members 40 is mounted in the position which will become the first straight portion 24 and the other alignment member 40 is received on the ends 30 of the solder tails. FIG. 8 shows the alignment members 40 secured to the electrical connector solder tails 22. Once the alignment members are secured onto the electrical connector, an epoxy is added to secure these alignment members thereto, or some other form is used to secure them thereon. The solder tails are then simultaneously bent forming the v-shaped bent portion 26 having the contact surfaces 28 thereon. The electrical connector is then ready to be mounted on to the circuit boards and provide electrical connection between the two individual circuit boards.

The alignment members 40 can include other features, one of the features is an alignment feature to provide alignment of the solder tails with the second circuit board. The alignment feature may be some hole or arm extending from the alignment feature which will be matched up with a complimentary alignment feature on the circuit board thereby ensuring that the solder tails are properly aligned with the contact pads on the second circuit board.

The advantages of the present invention are that the alignment member can be easily secured to the solder tails and can provide alignment of a large number of solder tails. While the Figures in the present invention only show the connector having four rows of electrical contacts, it is to be understood that the electrical connector can have many contacts forming a plurality of rows. The alignment member can be then formed to the appropriate length or cut to the appropriate length to provide an alignment for all of the solder tails. A further advantage is that the same alignment member 40 can be used at both positions, both on the street portion 24 and on the ends 26 provide proper alignment of the solder tails.

Figure 10:
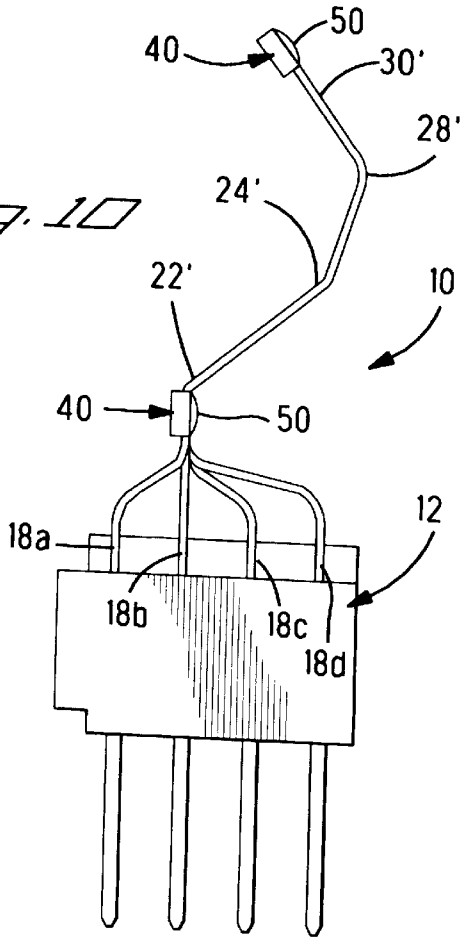
FIG. 10 is a side view showing an alternative configuration for the electrical connector.

FIG. 10 shows an alternative configuration for the solder tails 22'. FIG. 10 shows an electrical connector 10 which is in all respects the same as the electrical connector shown in previous Figures. The only difference is the manner in which the solder tails 22' are formed to generate the v-shaped sections, which are bent sections 24' in this embodiment, and the contact surfaces 28'. The alignment members 40 are not vertically aligned with each other in this embodiment, instead, the upper alignment member 40 and the ends 30' of the contacts are bent at an angle. Further, the solder tails 22' can be configured to have a flatter contact surface 28' to provide more area for electrical connection with contact pads on the circuit board. The two configurations of the formed electrical connector are just examples and it is to be understood that the electrical connector could be formed into many different configurations.

The electrical connector of the present invention and many of its attended advantages will be understood from the foregoing description. It is apparent that various changes may be made in the form, construction, an arrangement of parts thereof without departing from the field or scope of the invention, or sacrificing all of its material advantages.

What is claimed is:

1. An electrical connector, comprising:

a housing having a plurality of contacts mounted therein, the contacts having connection sections and solder tails, the solder tails being aligned with each other and having contact surfaces and ends;

an alignment member having grooves therealong to receive the solder tails therein, the solder tails being secured within the grooves, and a second alignment member being received on the ends of the solder tails, the contact surfaces having an alignment member disposed on either side, to ensure that the solder tails are properly aligned with each other.

2. The electrical connector of claim 1, wherein the connection sections are pins to be received in through holes in a circuit board.

3. The electrical connector of claim 2, wherein the contacts are staggered within the housing, the contacts being bent outside of the housing between the housing and the solder tails so that the solder tails are aligned.

4. The electrical connector of claim 3, wherein the solder tails have straight sections, bent sections having the contact surfaces, and ends, a second alignment member being received on the ends of the solder tails.

5. The electrical connector of claim 4, wherein the alignment member is secured to the contacts by epoxy.

6. The electrical connector of claim 1, wherein the second alignment member is identical to the first alignment member.

7. The electrical connector of claim 1, wherein the contacts are disposed within the housing in columns, the contacts being staggered within the columns thereby allowing the solder tails to be verically aligned.

8. An electrical-connector for providing electrical connection from a-first circuit board to a second circuit board, the connector comprising a housing having a plurality of contacts therein, the contacts having a connection section for electrically connecting with the first circuit board, the contacts having solder tails with contact surfaces for electrical connection with the second circuit board, an alignment member having grooves therealong, the solder tails being received and secured within the grooves, and a second alignment member being received on the ends of the solder tails, the contact surfaces having an alignment member disposed on either side, to ensure proper alignment of the solder tails.

9. The electrical connector of claim 8, wherein the connection sections are pins to be received in through holes in a circuit board.

10. The electrical connector of claim 9, wherein the contacts are staggered within the housing, the contacts being bent outside of the housing between the housing and the solder tails so that the solder tails are aligned.

11. The electrical connector of claim 10, wherein the solder tails have straight sections, bent sections having the contact surfaces, and ends, a second alignment member being received on the ends of the solder tails.

12. The electrical connector of claim 11, wherein the alignment member is secured to the contacts by epoxy.

13. The electrical connector of claim 8, wherein the second alignment member is identical to the first alignment member.

14. The electrical connector of claim 8, wherein the contacts are disposed within the housing in columns, the contacts being staggered within the columns thereby allowing the solder tails to be vertically aligned.

15. An electrical connector, comprising:

a housing having a plurality of contacts mounted therein, the contacts having connection sections and solder tails, the connection sections being pins to be received in through holes in a circuit board, the solder tails being aligned with each-other and having contact surfaces;

an alignment member having grooves therealong to receive the solder tails therein, the solder tails being secured within the grooves to ensure that the solder tails are properly aligned with each other.

16. The electrical connector of claim 15, wherein the contacts have ends and a second alignment member is received on the ends, the contact surfaces having an alignment member disposed on either side of it along the solder tails.

17. The electrical connector of claim 16, wherein the contacts are staggered within the housing, the contacts being bent outside of the housing between the housing and the solder tails so that the solder tails are aligned.

18. The electrical connector of claim 17, wherein the solder tails have straight sections, bent sections having the contact surfaces, and ends, a second alignment member being received on the ends of the solder tails.

19. The electrical connector of claim 18, wherein the alignment member is secured to the contacts by epoxy.

20. The electrical connector of claim 16, wherein the second alignment member is identical to the first alignment member.

21. The electrical connector of claim 15, wherein the contacts are disposed within the housing in columns, the contacts being staggered within the columns thereby allowing the solder tails to be vertically aligned.

* * * * *